US006349688B1

(12) United States Patent
Gracyalny et al.

(10) Patent No.: US 6,349,688 B1
(45) Date of Patent: Feb. 26, 2002

(54) DIRECT LEVER OVERHEAD VALVE SYSTEM

(75) Inventors: Gary J. Gracyalny, Milwaukee; Richard J. Fotsch; David Procknow, both of Elm Grove; Art Poehlman, West Bend; Scott A. Funke, New Berlin, all of WI (US)

(73) Assignee: Briggs & Stratton Corporation, Milwaukee, WI (US)

( * ) Notice: Subject to any disclaimer, the term of this patent is extended or adjusted under 35 U.S.C. 154(b) by 0 days.

(21) Appl. No.: 09/507,070

(22) Filed: Feb. 18, 2000

(51) Int. Cl.[7] ..... F01L 1/18

(52) U.S. Cl. ..... 123/90.39; 123/90.16; 123/90.17

(58) Field of Search ..... 123/90.39, 90.15, 123/90.16, 90.17, 90.18, 90.31, 90.4, 90.43

(56) References Cited

U.S. PATENT DOCUMENTS

| | | | | |
|---|---|---|---|---|
| RE14,228 | E | 12/1916 | MacVicar | |
| 1,404,183 | A | 1/1922 | Augustine | |
| 1,500,166 | A | 7/1924 | Van Ranst | |
| 1,647,851 | A | 11/1927 | Bentley | |
| 1,791,187 | A | 2/1931 | Brauchler | |
| 2,502,737 | A | 4/1950 | Meley et al. | |
| 2,980,089 | A | 4/1961 | Sampietro | |
| 3,367,277 | A | 2/1968 | Andrews et al. | |
| 3,418,985 | A | 12/1968 | Hirose | |
| 3,487,818 | A | 1/1970 | Dineen | |
| 3,747,433 | A | 7/1973 | Crowe | |
| 3,818,577 | A | 6/1974 | Bailey et al. | |
| 3,841,280 | A * | 10/1974 | Lussier | 123/90.39 |
| 3,882,834 | A * | 5/1975 | Goloff et al. | 123/90.43 |
| 3,932,053 | A | 1/1976 | Hack | |
| 4,030,179 | A | 6/1977 | Schwarz | |
| 4,067,666 | A | 1/1978 | Richards | |
| 4,191,238 | A | 3/1980 | Pichl | |
| 4,305,311 | A | 12/1981 | McGill | |
| 4,369,742 | A | 1/1983 | Everts | |
| 4,380,216 | A | 4/1983 | Kandler | |
| 4,430,969 | A * | 2/1984 | Holtzberg et al. | 123/90.39 |
| 4,440,121 | A * | 4/1984 | Clancy et al. | 123/90.39 |
| 4,494,286 | A | 1/1985 | Kaufman | |
| 4,510,897 | A | 4/1985 | Hatz et al. | |
| 4,594,973 | A * | 6/1986 | Allred et al. | 123/90.4 |
| 4,662,323 | A | 5/1987 | Moriya | |

(List continued on next page.)

FOREIGN PATENT DOCUMENTS

| | | |
|---|---|---|
| EP | 0 779 412 A2 | 6/1997 |
| GB | 2 159 877 | 12/1985 |
| GB | 2 266 753 | 10/1993 |
| JP | 54-36414 | 3/1979 |
| JP | 100576 | 4/1995 |
| JP | 8-177416 | 7/1996 |
| JP | 10288019 | 10/1998 |
| WO | WO99/45243 | 9/1999 |

*Primary Examiner*—Teresa Walberg
*Assistant Examiner*—Fadi M. Dahbour
(74) *Attorney, Agent, or Firm*—Michael Best & Friedrich LLP

(57) ABSTRACT

An overhead valve engine including a cylinder bore having an outer end; and a crankshaft assembly including a substantially straight crankshaft, a substantially cylindrical journal eccentrically mounted on the crankshaft, a one-piece connecting rod rotatably mounted on the journal, and a counterweight mounted on the crankshaft. The engine also includes a cam shaft having at least one cam surface and an axis inward of the outer end of the cylinder bore; two valves having opened and closed positions; two valve stems, each valve stem being attached to a valve; and two generally L-shaped and pivotably mounted valve operating levers, each lever including a first lever arm having a cam follower in contact with the cam surface, a pivot axis about which the lever pivots, and a valve arm in contact with a valve stem, where movement of the lever caused by the cam surface causes the lever to pivot and the valve arm to depress the valve stem and thus open the valve.

31 Claims, 10 Drawing Sheets

U.S. PATENT DOCUMENTS 4,688,446 A 8/1987 Ishikawa
4,691,590 A 9/1987 Geringer et al.
4,716,861 A 1/1988 Fujikawa et al.
4,736,717 A 4/1988 Fujikawa et al.
4,739,733 A 4/1988 Hartmann et al.
4,829,802 A 5/1989 Baumann
4,872,429 A 10/1989 Anderson et al.
5,033,945 A 7/1991 Kolb
5,054,440 A 10/1991 Kadokawa
5,101,778 A 4/1992 Fukuo et al.
5,159,852 A * 11/1992 Harimoto ..... 123/90.39
5,176,116 A 1/1993 Imagawa et al.
5,189,928 A 3/1993 Ontrop et al.
5,193,413 A 3/1993 Kizler et al.
5,237,892 A 8/1993 Fry
5,241,932 A 9/1993 Everts
5,267,536 A 12/1993 Imagawa et al.
5,287,840 A 2/1994 Catanu et al.
5,293,847 A 3/1994 Hoffman et al.
5,357,917 A 10/1994 Everts
5,364,234 A 11/1994 Eickmann
5,394,843 A * 3/1995 Decuir ..... 123/90.39
5,456,136 A * 10/1995 Yamashita et al. ..... 123/90.16
5,490,408 A 2/1996 Ando et al.
5,524,507 A 6/1996 Olmr et al.
5,560,333 A 10/1996 Genouille
5,671,707 A * 9/1997 Purcell et al. ..... 123/90.39
5,706,769 A 1/1998 Shimizu
5,722,036 A 2/1998 Shikata et al.
5,732,670 A * 3/1998 Mote, Sr. ..... 123/90.39
5,737,976 A 4/1998 Haman
5,738,062 A 4/1998 Everts
5,860,403 A 1/1999 Hirano et al.
5,884,593 A 3/1999 Immel et al.
5,901,675 A 5/1999 Nakagomi
5,951,261 A 9/1999 Paczuski
5,970,933 A * 10/1999 Ueda et al. ..... 123/90.39
5,974,663 A 11/1999 Ikeda et al.
6,092,497 A * 7/2000 Preston et al. ..... 123/90.16
6,205,966 B1 * 3/2001 Breitenberger ..... 123/90.4

* cited by examiner

DIRECT LEVER OVERHEAD VALVE SYSTEM

FIELD OF THE INVENTION

The present invention relates generally to internal combustion engines, and more particularly to a direct lever overhead valve system for controlling valve opening and closing.

BACKGROUND OF THE INVENTION

It is known to use V-shaped cam followers in combination with push rods 10 and rocker arms in a valve operating system in an overhead valve engine to thereby control movement of the valves. U.S. Pat. No. 5,357,917 to Everts is one example. However, the Everts device is a complicated combination of components operating between a cam and the valves.

SUMMARY OF THE INVENTION

The present invention is directed to a direct lever overhead valve system designed to directly control valve operation based on cam rotation. The direct lever system is particularly adapted to simplify valve operation by translating cam rotation directly to the valve stems.

The direct lever system may utilize a pair of generally L-shaped levers, each with a cam following surface on a first lever arm and a valve-operating surface at a second lever arm. The levers may be nestable and act about a common pivot.

The preferred embodiment of the invention provides an overhead valve engine including a cylinder bore having an outer end; and a crankshaft assembly including a substantially straight crankshaft, a substantially cylindrical journal eccentrically mounted on the crankshaft, a one-piece connecting rod rotatably mounted on the journal, a counterweight mounted on the crankshaft, and a timing gear mounted on the crankshaft. The engine also includes a cam shaft having a cam surface and an axis inward of the outer end of the cylinder bore; two valves having opened and closed positions; two valve stems, each valve stem being attached to a valve; and two generally L-shaped and pivotably mounted valve operating levers, each lever including a first end having a cam follower in contact with the cam surface, a pivot axis about which the lever pivots, and a valve arm in contact with a valve stem, where movement of the lever caused by the cam surface causes the lever to pivot and the valve arm to depress the valve stem and thus open the valve.

The invention also provides a direct lever system for an overhead valve engine, the system including a cylinder bore having an outer end; a cam shaft having a cam lobe and an axis inward of the outer end of the cylinder bore; two valves having opened and closed positions; and two valve stems, each valve stem being attached to a valve. The direct valve system also includes two generally L-shaped and pivotably mounted valve operating levers, each lever including a first lever arm having a cam follower in contact with the cam lobe, a pivot axis about which the lever pivots, and a valve arm in contact with a valve stem, where movement of the lever caused by the cam lobe causes the lever to pivot and the valve arm to depress the valve stem and thus open the valve.

The pivot axes of the levers can be coincidental. Alternatively, the direct lever system may employ a pair of generally L-shaped levers that are not nested and that act on separate but substantially parallel pivots.

The invention also provides a crankshaft assembly for an engine, the assembly including a substantially straight crankshaft; a substantially cylindrical journal eccentrically mounted on the crankshaft; a one-piece connecting rod rotatably mounted on the journal; a counterweight mounted on the crankshaft; and a timing gear mounted on the crankshaft.

The invention also provides a process for manufacturing a connecting rod having a desired connecting rod shape and a desired thickness for an overhead valve engine, the process including extruding a bar of material with a cross section substantially similar to the desired connecting rod shape and including an extruded bore; cutting the bar into substantially equivalent slices of the desired thickness; and finishing at least two bores in each slice.

Figure 1:
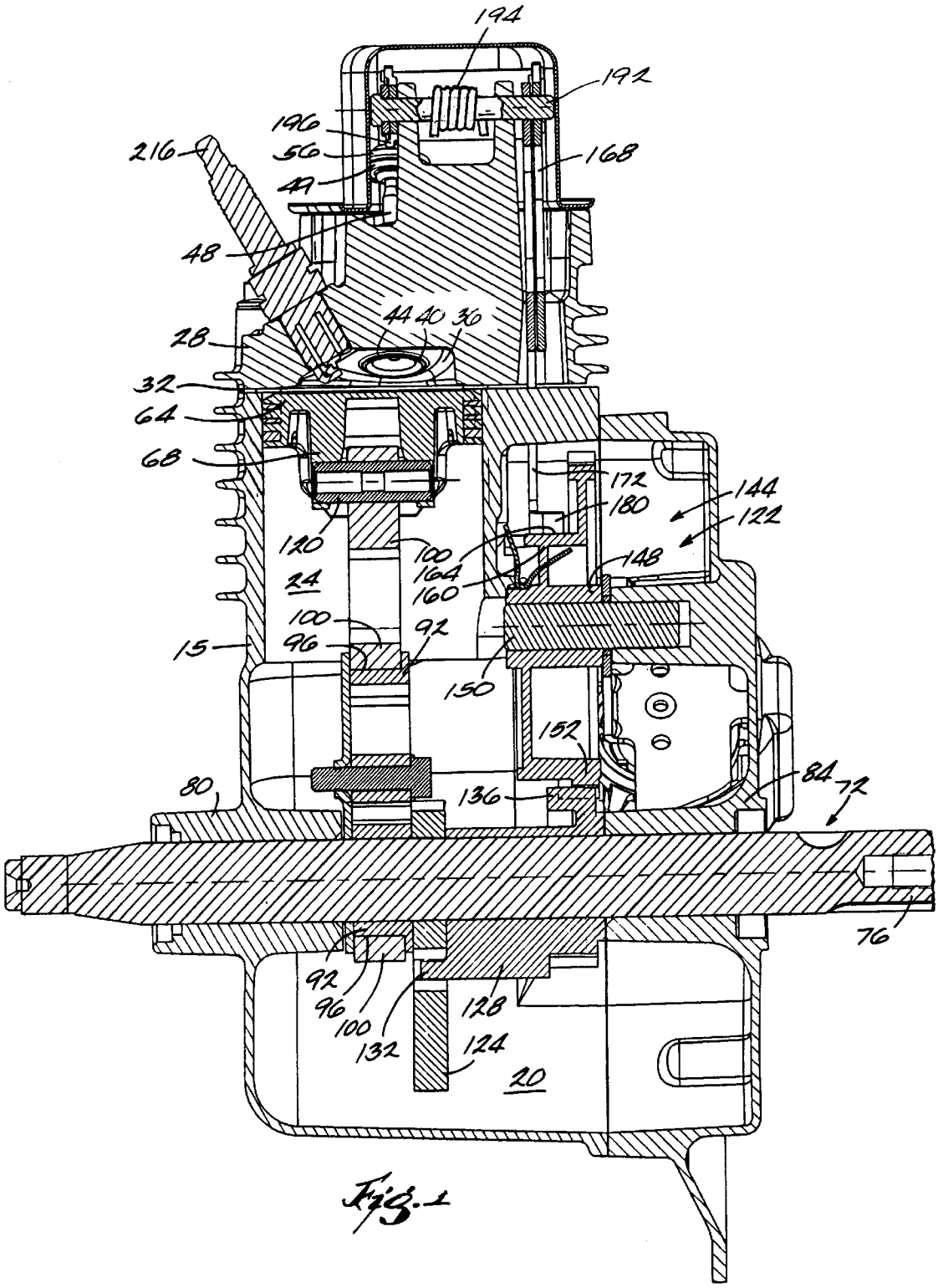
FIG. 1 is a cutaway elevation view of an overhead valve engine embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAIL DESCRIPTION OF THE INVENTION

FIG. 1 is a cutaway elevation view of an overhead valve engine 10. The overhead valve engine includes an engine housing 15. The engine housing 15 includes a crankcase 20 and a cylinder bore 24. It should be noted that, in this description, "outer" refers to a direction away from the crankcase 20, and "inward" refers to a direction toward the crankcase 20. The cylinder bore 24 has an outer end 32 where the cylinder bore 24 meets a cylinder head 28. The head 28 is mounted to the engine housing 15 such that the head 28 encloses the outer end 32 of the cylinder bore 24. In an alternate embodiment, the cylinder head 28 could be integrally-formed with the engine housing. The head 28 includes a combustion chamber 36 where the head 28 encloses the cylinder bore 24. An intake valve port (not shown) in the head 28 between the combustion chamber 36 and an intake manifold (not shown) contains an intake valve seat (not shown). An exhaust valve port (not shown) in the head 28 between the combustion chamber 36 and an exhaust manifold (not shown) contains an exhaust valve seat 40.

The overhead valve engine 10 also includes an exhaust valve 44 that defines a closed position when the exhaust valve 44 is seated within the exhaust valve seat 40 to close the exhaust valve port. The exhaust valve 44 defines an open position when the exhaust valve 44 is spaced from the exhaust valve seat 40, thus providing a pathway from the combustion chamber 36 through the exhaust valve port to the exhaust manifold.

The overhead valve engine 10 also includes an intake valve (not shown) that defines a closed position when the intake valve is seated within the intake valve seat to close the intake valve port. The intake valve defines an open position when the intake valve is spaced from the intake valve seat, thus providing a pathway from the intake manifold through the intake valve port to the combustion chamber 36. The intake and exhaust valve ports are generally aligned in a plane perpendicular to the crankshaft axis. In alternate embodiments, the ports may have any other suitable arrangement. The intake and exhaust valves are angled toward each other to produce a pent-roof combustion chamber 36. In alternate embodiments, the intake and exhaust valves could also be parallel to the bore 24.

The overhead valve engine 10 also includes exhaust and intake valve stems 48, 52 (see FIG. 3) with proximal and distal ends. The exhaust and intake valve stems 48, 52 are attached at the proximal ends to the exhaust valve 44 and the intake valve, respectively. Valve stem caps 56, 60 cover the distal ends of the exhaust and intake valve stems, respectively. A valve stem 48, 52 along with a valve stem cap 56, 60 or other lash adjuster form a valve stem assembly.

The overhead valve engine 10 also includes compression springs (not shown) that surround each valve stem 48, 52 and spring retainers 49, 51 to provide a biasing force to maintain each valve in a closed position when the valves are not otherwise moved. The springs also provide force to retain contact between the valve system components when the valves are in the open position.

The overhead valve engine 10 also includes a generally cylindrical piston 64 (see FIG. 1) having a lower or skirt end 68. The piston 64 is mounted for reciprocal, translational motion within the cylinder bore 24.

Figure 5:
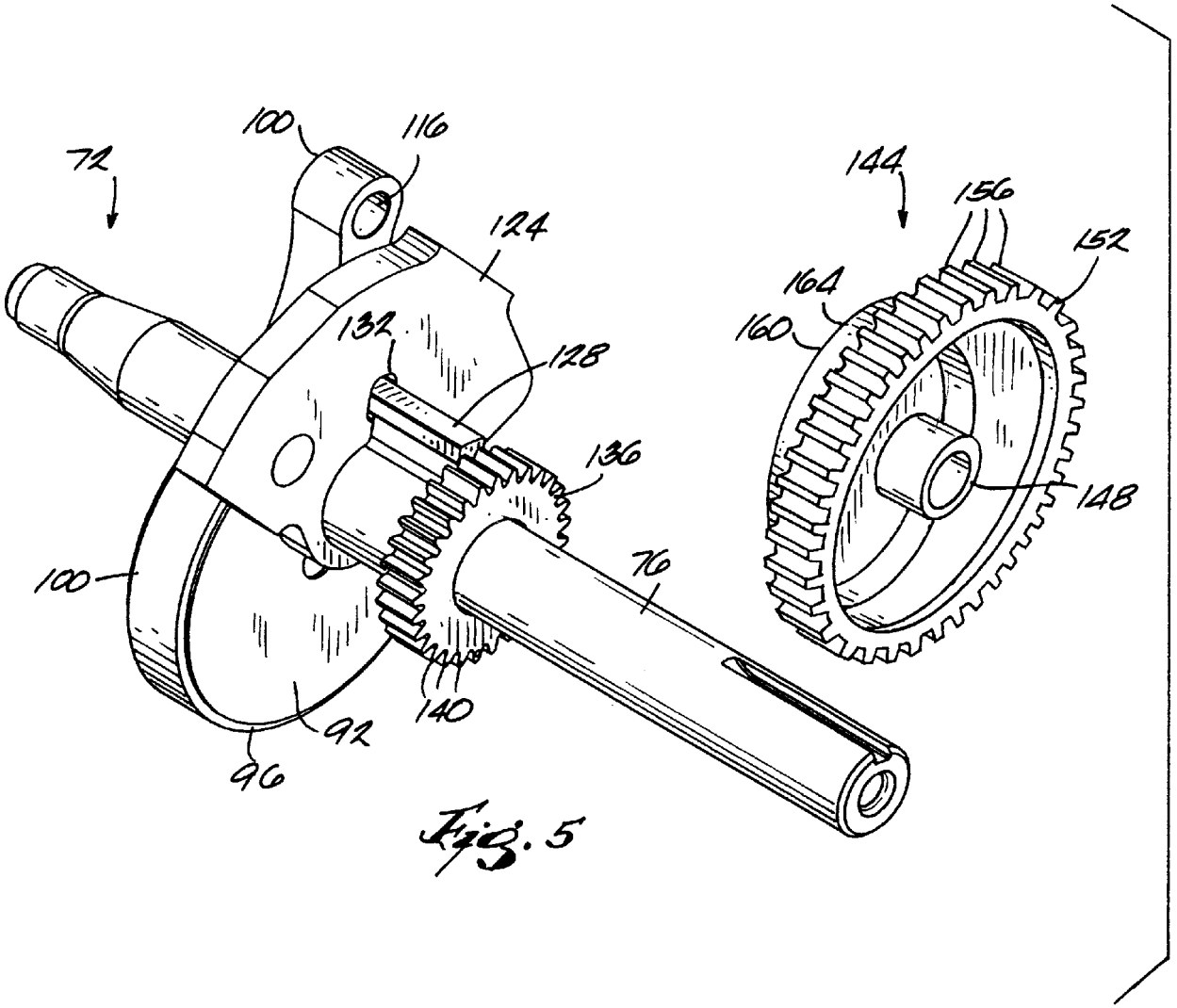
FIG. 5 is a perspective view of a cam gear and a crankshaft with a counterweight, eccentric, and connecting rod for the overhead valve engine of FIG. 1.

Referring to FIGS. 1 and 5, the overhead valve engine 10 also includes a crankshaft assembly 72 that is rotatably mounted in the engine housing 15, substantially within the crankcase 20 (see FIG. 1). The crankshaft assembly 72 defines a rotational speed as it rotates in the engine housing 15. The crankshaft assembly 72 preferably includes a substantially straight, knurled shaft 76 mounted for rotational movement. The shaft 76 is supported by two crankshaft journals 80, 84. A combination flywheel/cooling fan 88 is mounted on one end of the shaft 76 outside of the engine housing 15 (see FIG. 2). The other end of the shaft 76 is used to drive a device such as a lawnmower blade, line cutter, pump, or generator (not shown).

The crankshaft assembly 72 also includes a substantially cylindrical journal or eccentric 92 eccentrically mounted on the shaft (see FIG. 5). The eccentric 92 is affixed to the shaft 76 such that the eccentric 92 rotates coincidentally with the shaft 76. The eccentric 92 includes a journal surface 96 on the outer edge of the eccentric 92.

In an alternate embodiment, the crankshaft assembly 72 could include a multi-piece crankshaft, or eccentric 92 could be formed integrally with the crankshaft 76. In another alternate embodiment, the eccentric 92 may be replaced by any suitable arrangement. In still another alternate embodiment, any suitable conventional crankshaft could be used.

Figure 6:
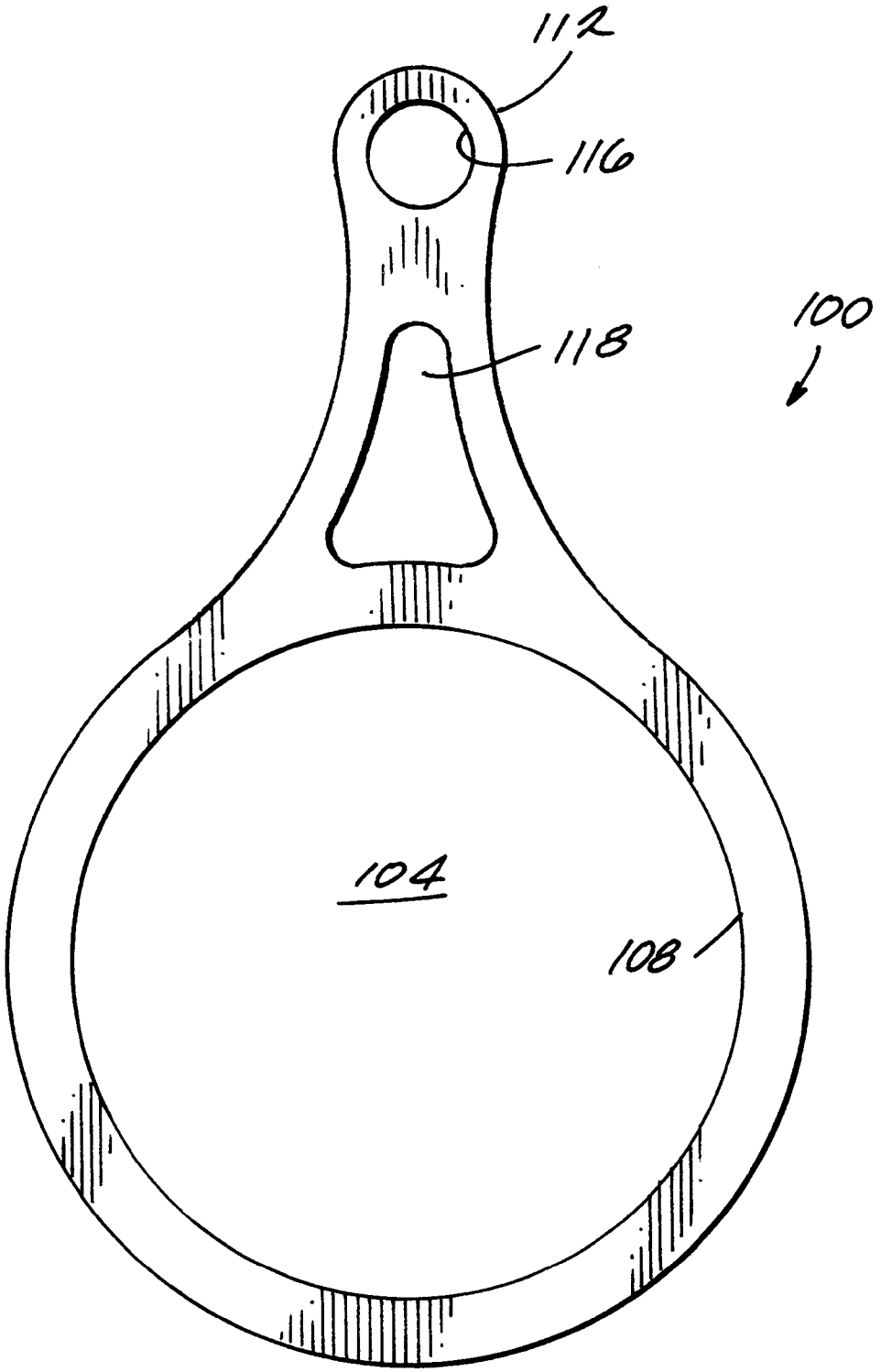
FIG. 6 is a plan view of the connecting rod of FIG. 5.

Referring to FIGS. 1 and 6, the crankshaft assembly 72 includes a one-piece extruded connecting rod 100 (see FIG. 6) that is rotatably mounted on the eccentric 92. In alternative embodiments, the connecting rod 100 may also be die cast or manufactured by any other suitable method. In other alternative embodiments, the connecting rod 100 may be formed from more than one piece. The connecting rod 100 includes a journal bore 104 with an inner bearing surface 108 (see FIG. 6) that slidably engages the journal surface 96 of the eccentric 92 (see FIG. 1). A piston end 112 of the connecting rod 100 contains a piston end bore 116 and is pivotably connected to the skirt end 68 of the piston 64 (see FIG. 1). An aperture 118 can be provided to reduce the weight of the connecting rod 100. A wrist pin 120 is placed through the piston end bore 116 of the connecting rod 100 (see FIG. 6) and anchors the piston end 112 of the connecting rod 100 to the skirt end 68 of the piston 64 (see FIG. 1).

Figure 10:
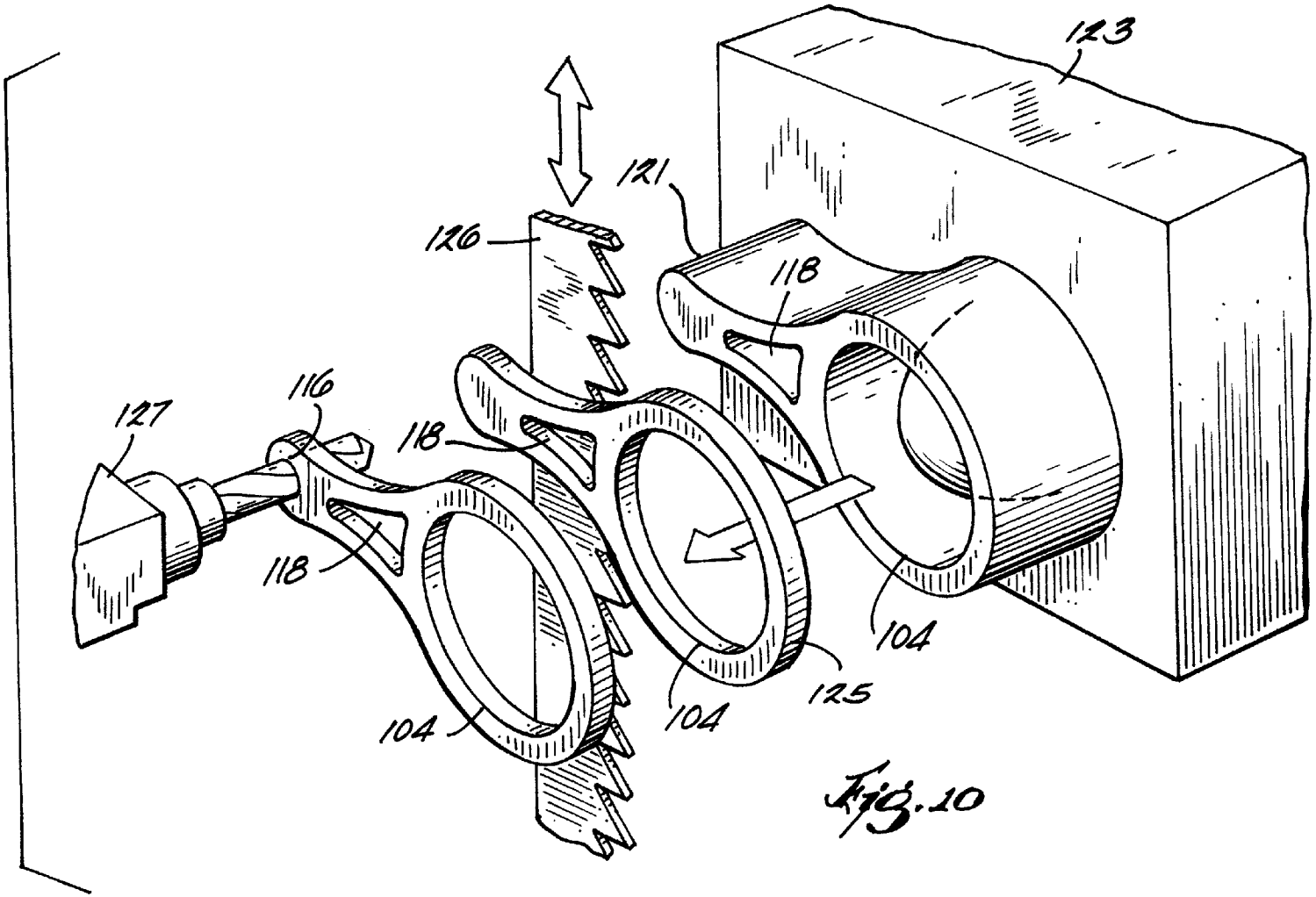
FIG. 10 schematically illustrates the process for manufacturing the connecting rod shown in FIG. 6.

The connecting rod 100 may be manufactured as illustrated in FIG. 10. A connecting rod stock 121 is extruded from an extruder 123 and then cut transversely into slices 125 of substantially similar thicknesses using a saw 126 or other suitable cutting device. The connecting rod 100 is preferably extruded with a rough journal bore 104 and aperture 118 during extrusion. In that case, the journal bore 104 is then finished and the piston end bore 116 is bored using a borer 127 and finished to produce a one-piece connecting rod 100. In alternate embodiments, the extrusion may be performed with two or no bores, with the bores and the aperture being finished after extrusion.

Referring to FIG. 1, the overhead valve engine 10 also includes a slot 122 in the engine housing 15 to accommodate the assembly of the engine 15 using the one-piece connecting rod 100.

The crankshaft assembly 72 also includes a counterweight 124 affixed to the shaft 76 (see FIG. 5) to counterbalance forces generated by the reciprocating piston 64 and connecting rod 100. The counterweight 124 is affixed to the shaft 76 such that the counterweight 124 rotates coincidentally with the shaft 76.

The crankshaft assembly 72 also includes a timing gear 136 affixed to the shaft 76. The timing gear 136 is affixed to the shaft 76 with a key 128 and keyway 132 arrangement (see FIG. 5) such that the timing gear 136 rotates coincidentally with the shaft 76 and has the same rotational speed as the crankshaft assembly 72. The timing gear 136 includes a plurality of teeth 140.

Figure 3:
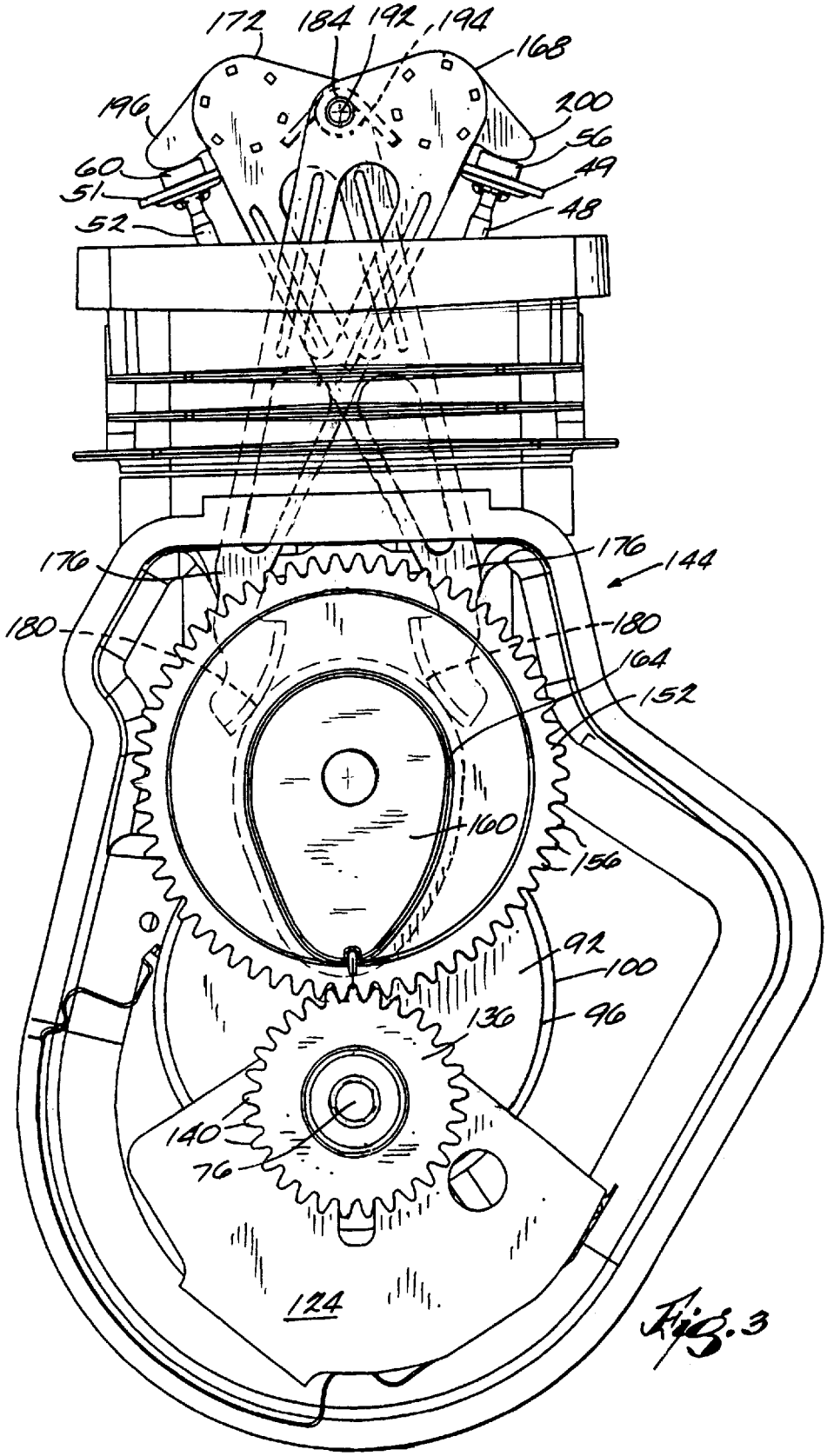
FIG. 3 is a bottom view of the overhead valve engine of FIG. 1, with an engine base removed.

Referring to FIGS. 1, 3, and 5, the overhead valve engine 10 includes a cam assembly 144 that is rotatably mounted in the engine housing 15 and has an axis inward of the outer end 32 of the cylinder bore 24.

The cam assembly 144 also includes a cam gear 152. The cam gear 152 includes a plurality of teeth 156 that mesh with the teeth 140 of the timing gear 136 such that the timing gear 136 directly drives the cam gear 152. The cam gear 152 has twice the number of teeth 156 as the timing gear 136 such that the cam gear 152 turns at half of the rotational speed of the timing gear 136. In an alternative embodiment (not shown), an idler gear system may be employed between the timing gear 136 and the cam gear 152 such that the timing gear 136 drives an idler gear that in turn drives the cam gear 152.

The cam assembly 144 also includes a cam hub 148 that is formed as a single unit with the cam gear 152. The cam assembly 144 is rotatably mounted on a pin 150 pressed into the housing 15. The cam hub 148 rides on and rotates about an end of the pin 150. In an alternate embodiment, the cam assembly 144 includes a cam shaft that is rotatably mounted to the engine housing 15. In another alternate embodiment, the cam gear 152 and the cam hub 148 may be separate pieces.

The cam assembly 144 also includes a cam lobe 160 formed as a single piece with and turning coincidentally with the cam gear 152. The cam lobe 160 includes a cam surface 164. In alternative embodiments, the cam assembly 144 may include more than one cam lobe 160, in which case each cam lobe would likely be of different shapes, sizes, radii, or orientations producing different valve motion characteristics. In another alternate embodiment, the cam lobe 160 and the cam gear 152 may be separate pieces and/or different materials.

Figure 4:
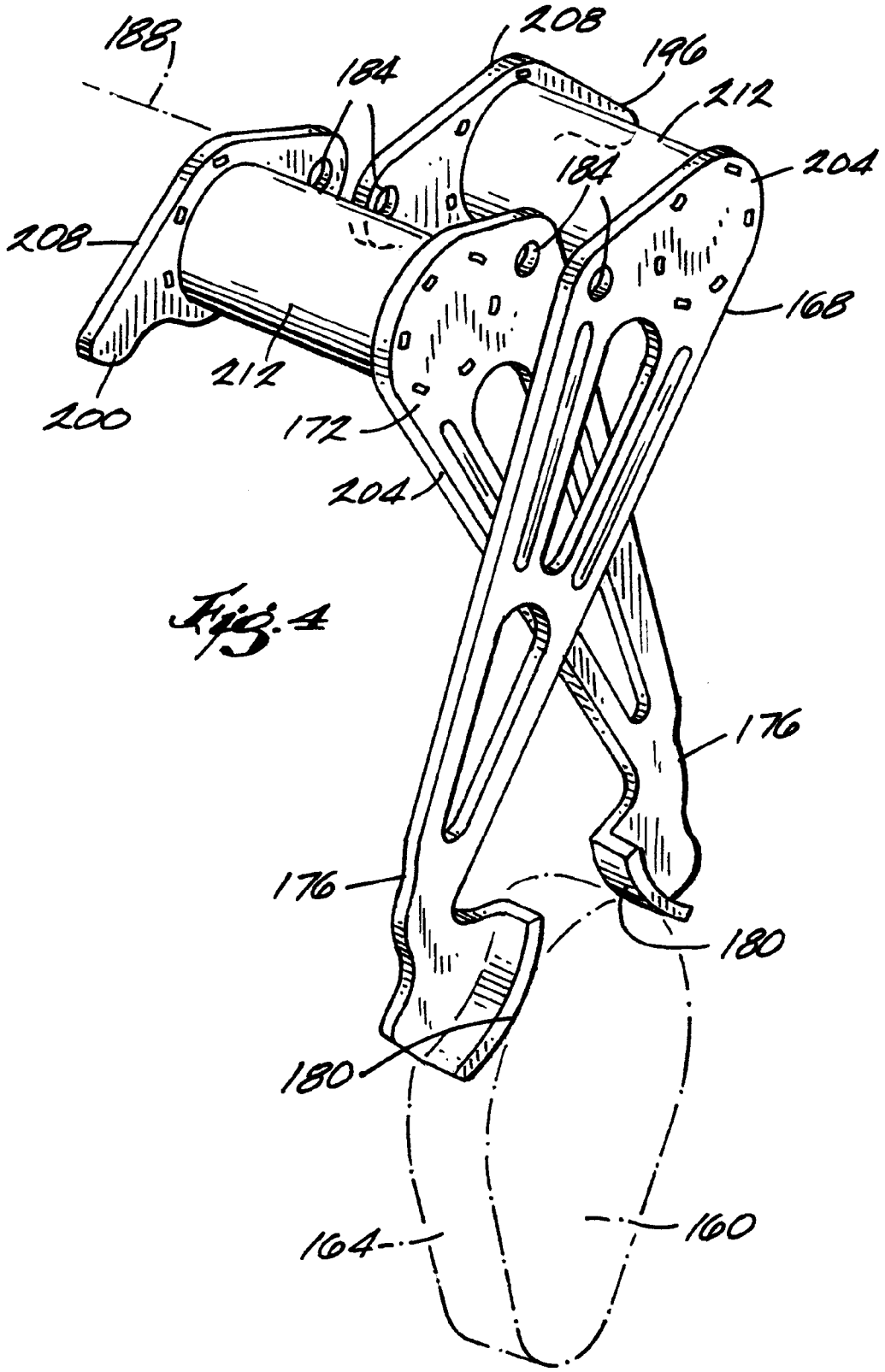
FIG. 4 is a perspective view of a direct lever system of the preferred embodiment of the present invention for the overhead valve engine of FIG. 1.

Referring to FIGS. 3 and 4, the overhead valve engine 10 also includes overlapping and generally L-shaped exhaust and intake valve operating levers 168, 172. Each lever 168, 172 includes a first lever arm 176 having a generally convex cam follower 180 that is in contact with the cam surface 164.

Figure 2:
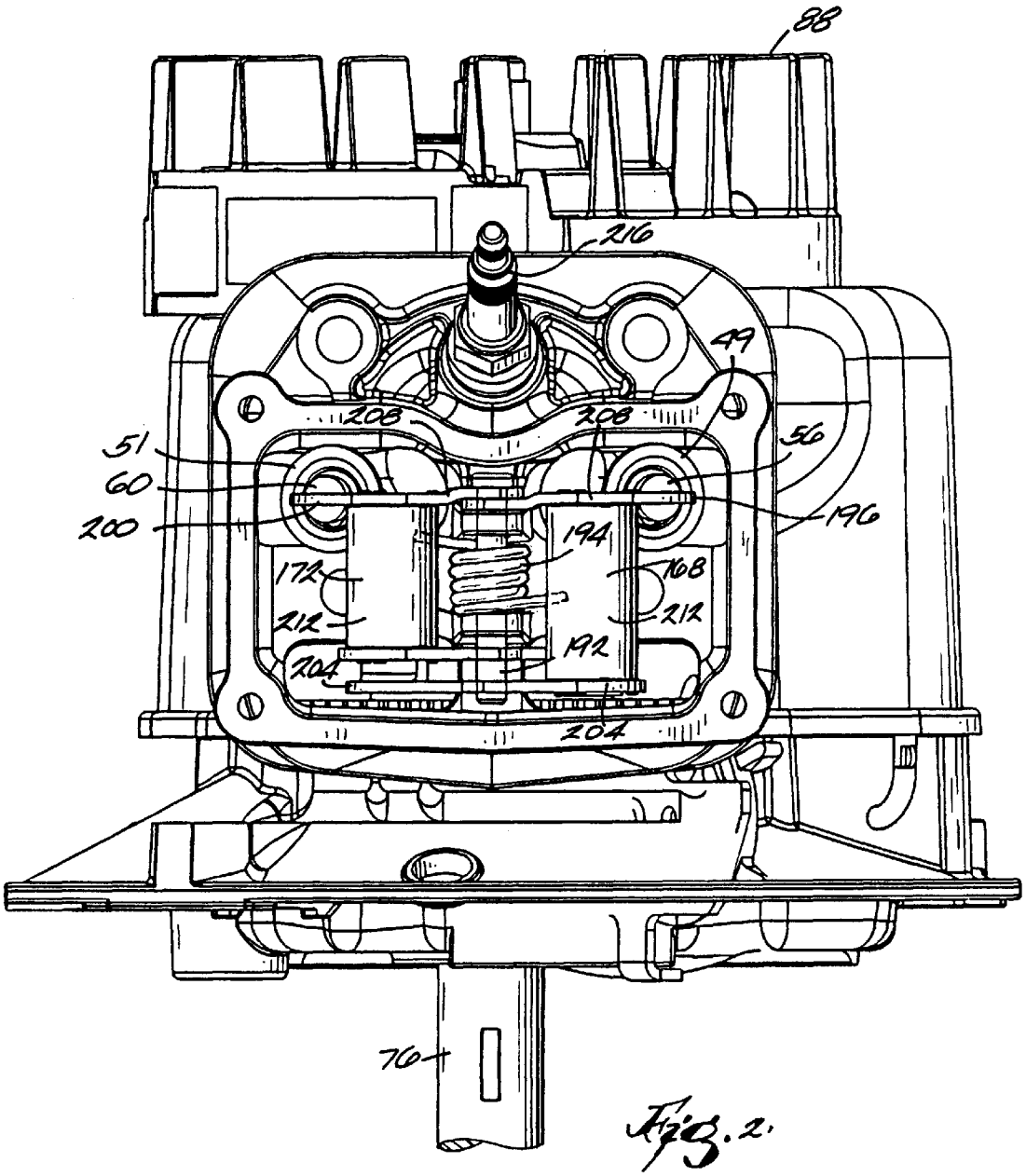
FIG. 2 is an end view of the overhead valve engine of FIG. 1.

Each lever 168, 172 also includes a pair of aligned pivot bores 184 that define a pivot axis 188 about which the levers 168, 172 pivot. The pivot axes 188 for the levers 168, 172 are coincidental, as shown in FIGS. 2 and 4. Each lever 168, 172 is pivotably mounted to the engine 10 with a pivot pin 192 (see FIGS. 1 and 2).

A torsion spring 194 surrounds the pivot pin 192 and engages each lever 168, 172 such that each lever 168, 172 is biased to retain the cam followers 180 against cam surface 164. In an alternative embodiment, an extension spring, compression spring, or other biasing means may be used to either supplement or replace the biasing force of the torsion spring 194. In an alternative embodiment, larger, higher force valve stem compression springs may be used to bias both valve stem assemblies and levers, thus eliminating the need for a torsion spring and/or other biasing means.

Figure 7:
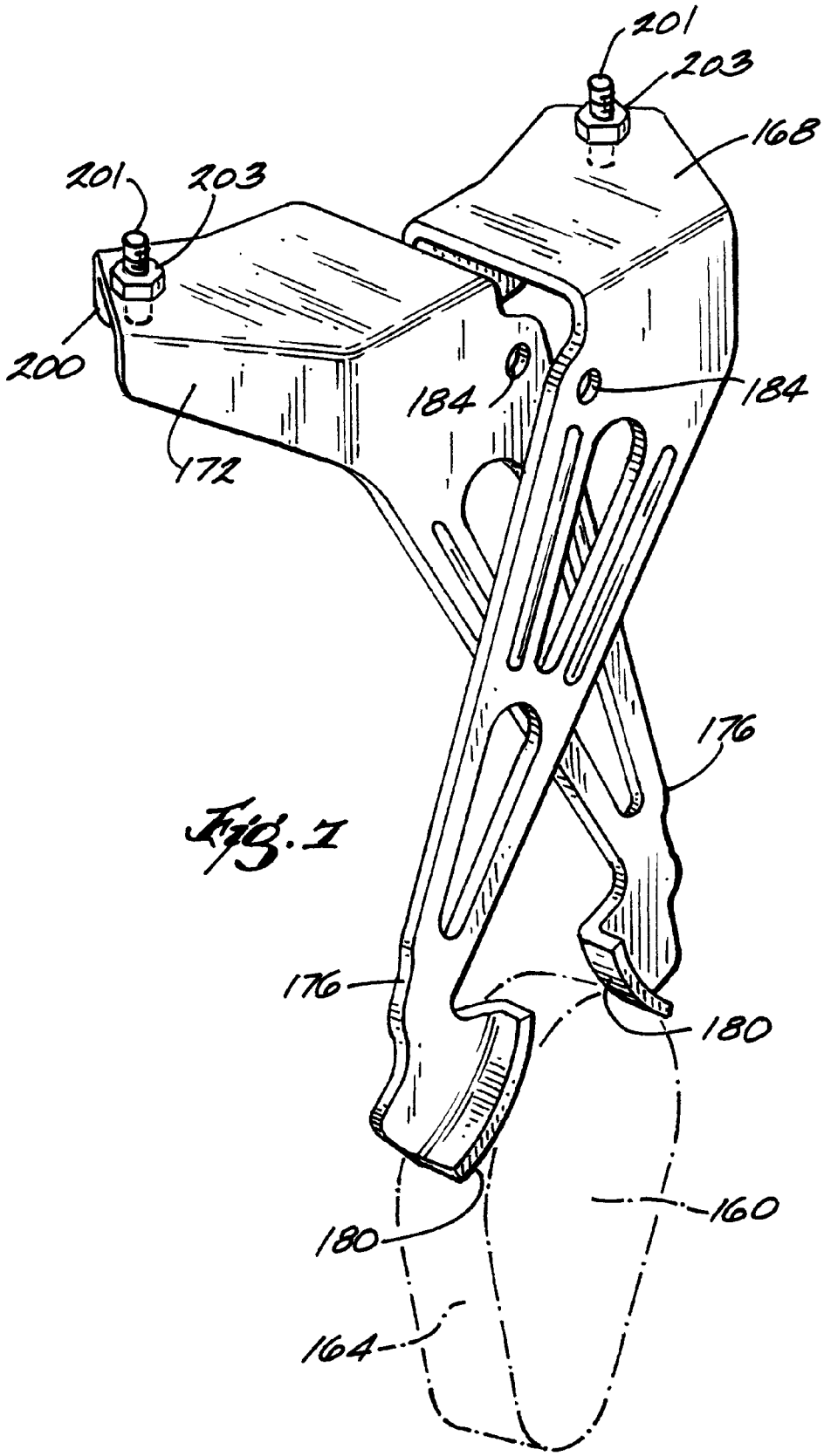
FIG. 7 is a perspective view of a direct lever system of an alternative embodiment of the present invention for the overhead valve engine of FIG. 1.

Each lever 168, 172 also includes a valve arm 196, 200 in contact with a valve stem cap 60, 56, respectively (see FIG. 3), such that rotational movement of lever 168, 172 causes the valve arm 196, 200 to depress the valve stem cap 60, 56, and thus the valve stem 52, 48 and the valve. Various thickness valve stem caps 56, 60 are used to take up the lash between the valve stem 48, 52 and the valve arm 200, 196 of the lever 172, 168. In an alternate embodiment, the lash adjuster may comprise a threaded screw 201 and a jam nut 203, as shown in FIG. 7, and may be used with or without valve caps 56, 60.

As best shown in FIG. 4, each lever 168, 172 is constructed from two stamped pieces 204, 208 and a tube 212. The three pieces 204, 208, 212 are resistance welded to form a lever 168, 172. The levers 168, 172 could have different designs and could be made by different methods. For example, each lever 168, 172 could be formed from a single stamped piece (see FIG. 7). The exhaust and intake levers 168, 172 need not be identical to each other if desired valve motion characteristics necessitate a difference in the levers 168, 172.

In operation of the overhead valve engine 10 as best illustrated in FIGS. 1 and 3, combustion of a compressed fuel/air mixture within the combustion chamber 36 caused by a spark from a spark plug 216 produces an expansion of combustion gases resulting in movement of the piston 64 inward, away from the cylinder bore outer end 32. Movement of the piston 64 in the inward direction pushes the connecting rod 100 in the inward direction. The connecting rod 100 slidably pushes on the eccentric 92, which, because the eccentric 92 is eccentrically mounted on the shaft 76, is effectively a lever arm causing the shaft 76 to rotate. As the shaft 76 rotates, the timing gear 136 rotates with it. The rotating timing gear 136 drives the cam gear 152, which causes the cam lobe 160 to rotate as well.

As the cam follower 180 of the exhaust lever 168 slides on the rotating cam surface 164, the increasing profile portion of the cam lobe 160 causes the cam follower 180 to be pushed outward. Outward movement of the cam follower 180 of the exhaust lever 168 causes the exhaust lever 168 to pivot about its pivot axis 188, resulting in the valve arm 200 of the exhaust lever 168 to be moved inwardly. Inward movement of the valve arm 200 depresses the valve stem cap 56, and thus the exhaust valve stem 48 and the exhaust valve 44 against the biasing force of the exhaust valve compression spring. As the exhaust valve 44 opens, continued rotation of the crankshaft assembly 72 results in the piston 64 being pushed upward, which pushes combustion gases out past the exhaust valve 44 and to the exhaust manifold. As the cam lobe 160 continues to turn, the cam follower 180 encounters a decreasing profile portion of the cam lobe 160 and the exhaust lever 168 begins to return to its original position under the biasing force of the exhaust lever torsion spring. Simultaneously, the exhaust valve 44 returns to its original closed position under the biasing force of the exhaust valve compression spring.

The cam lobe 160 continues to turn, causing the cam follower 180 of the intake lever 172 to encounter an increasing profile portion of the cam lobe 160. Again, that cam follower 180 moves outward, causing the intake lever 172 to pivot on its axis 188 and the associated valve arm 196 of the intake lever 172 to depress the valve stem cap 60 and thus the intake valve stem 52 and the intake valve against the biasing force of the intake valve compression spring. Opening the intake valve allows a fuel/air mixture to enter the cylinder bore 24 from the intake manifold above the piston 64 as the piston 64 again moves away from the outer end 32 of the cylinder bore 24, pulled by the connecting rod 100, eccentric 92, and shaft 76. Continued rotation of the cam lobe 160 causes the cam follower 180 to encounter a decreasing profile portion of the cam lobe 160, causing the intake lever 172 to return to its original position under the biasing influence of the intake lever torsion spring. As a result, the intake valve returns to the closed position under the biasing influence of the intake valve compression spring.

Finally, the shaft 76 continues to turn, causing the piston 64 to move toward the outer end 32 of the cylinder bore 24, thus compressing the air/fuel mixture and allowing the process to repeat itself.

The direct lever system for an overhead valve engine eliminates many engine components over prior art designs. A cam assembly arranged inward from a cylinder bore outer end and driven directly by a timing gear eliminates the need for a timing belt or chain running between the crankshaft and the cam in an overhead cam engine, and associated tensioning devices. A cam arranged inward from a cylinder bore outer end also eliminates the cam lubrication problems inherent in an overhead cam engine, and reduces the engine manufacturing costs. A cam arranged inward from a cylinder bore outer end also eliminates the negative dynamic effect of belt or chain elasticity.

Likewise, the direct lever system eliminates the cam followers, push rods, and rocker arms that are often separate components necessary in prior art overhead valve engines. Because torsion spring force counteracts the inertia forces of each valve operating lever, the valve stem compression spring may be smaller, lower force, and lower cost with the direct lever system because the compression spring only needs to counteract the inertial forces of the valve, valve stem, valve cap, and valve retainer, rather than the mass of the entire valve system. In addition, the direct lever system with the torsion spring reduces the forces on the valve assemblies, thus requiring less heat treatment of the valve stems or caps and allowing the use of smaller compression spring retainers.

The four-cycle process described above must occur very quickly. For example, an overhead valve engine 10 running at only 3600 rpm requires each valve to open and close 30 times per second. As a result, the components operating the valves and the valves themselves must respond very quickly to the rotation of the cam lobe 160. The natural frequency of the valve system must meet a minimum value to allow for the use of valve acceleration characteristics that are required to achieve good engine performance while promoting stable valve system dynamics.

The natural frequency of a system is proportional to the square root of the ratio of the stiffness of the system to the effective mass of the system. The effective mass includes the translating mass of the valve assemblies and the rotational inertia of the levers. Therefore, a system that has sufficiently high stiffness and low effective mass will produce adequate control of valve motion.

The direct lever system provides an inexpensive lever with sufficiently high stiffness and a low enough effective mass to achieve a desirable valve system natural frequency resulting in good engine performance and stable valve system dynamics. The cost savings associated with the direct lever system also reduce the cost of the engine.

In an alternative embodiment illustrated in FIG. 7, the levers 168, 172 are manufactured (e.g., by stamping) in a single piece yet effectively maintain the important structural components and operation of the preferred design described above.

Figure 8:
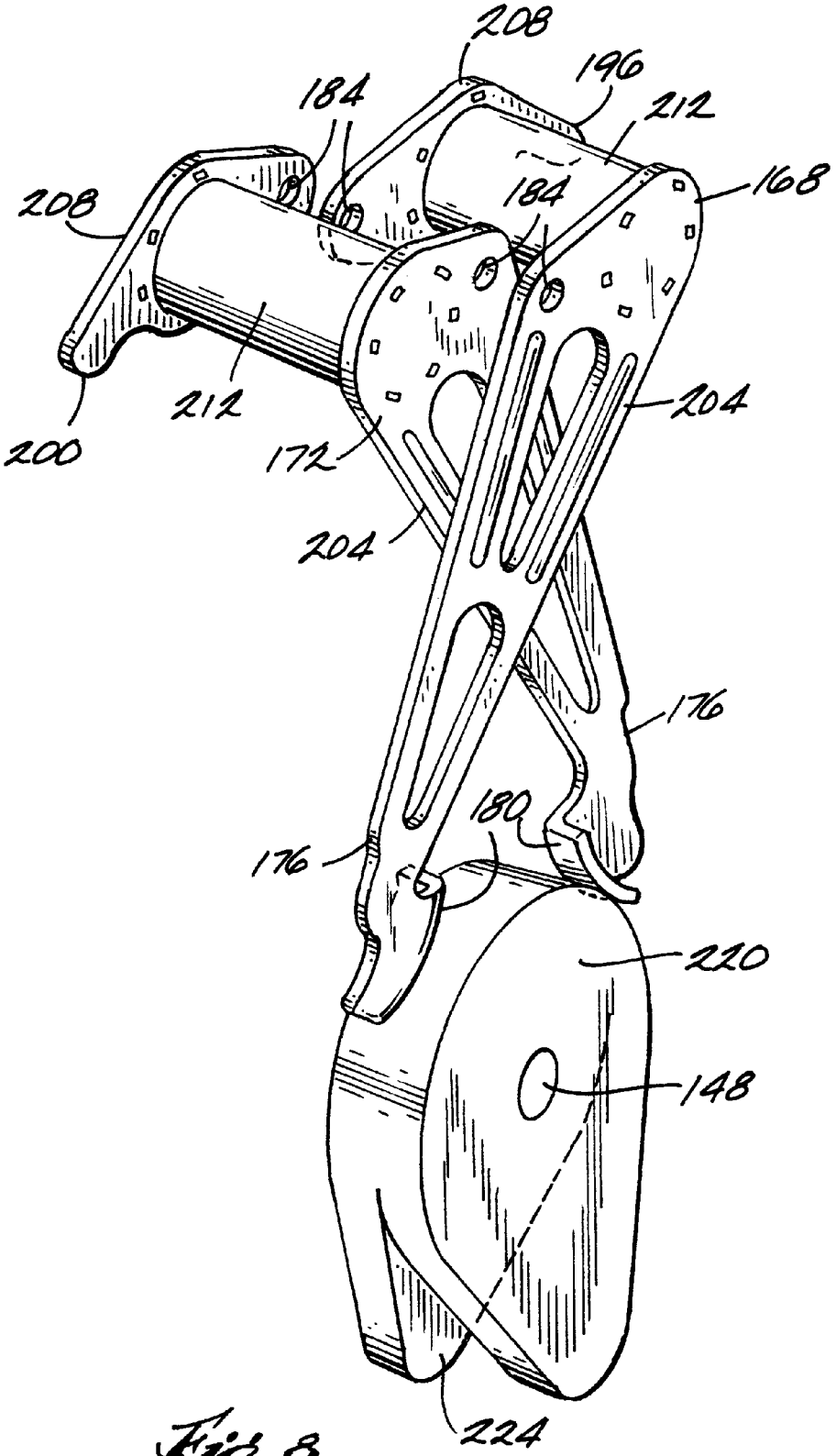
FIG. 8 is a perspective view of a direct lever system of an alternative embodiment of the present invention for the overhead valve engine of FIG. 1.

In a further alternative embodiment illustrated in FIG. 8, the single cam lobe 160 of the preferred embodiment can be replaced with a separate cam lobe 220, 224 for each lever. In this embodiment, cam lobes 220, 224 of differing radii and orientation may be used to alter the motion of each valve being controlled. In some circumstances, it may be desirable to have the valves be open for different lengths of time or open and close at different rates. Likewise, in alternative embodiments (not shown), the levers may be nearly identical but also need not be identical where different lever designs are desirable to effect different valve open characteristics.

Figure 9:
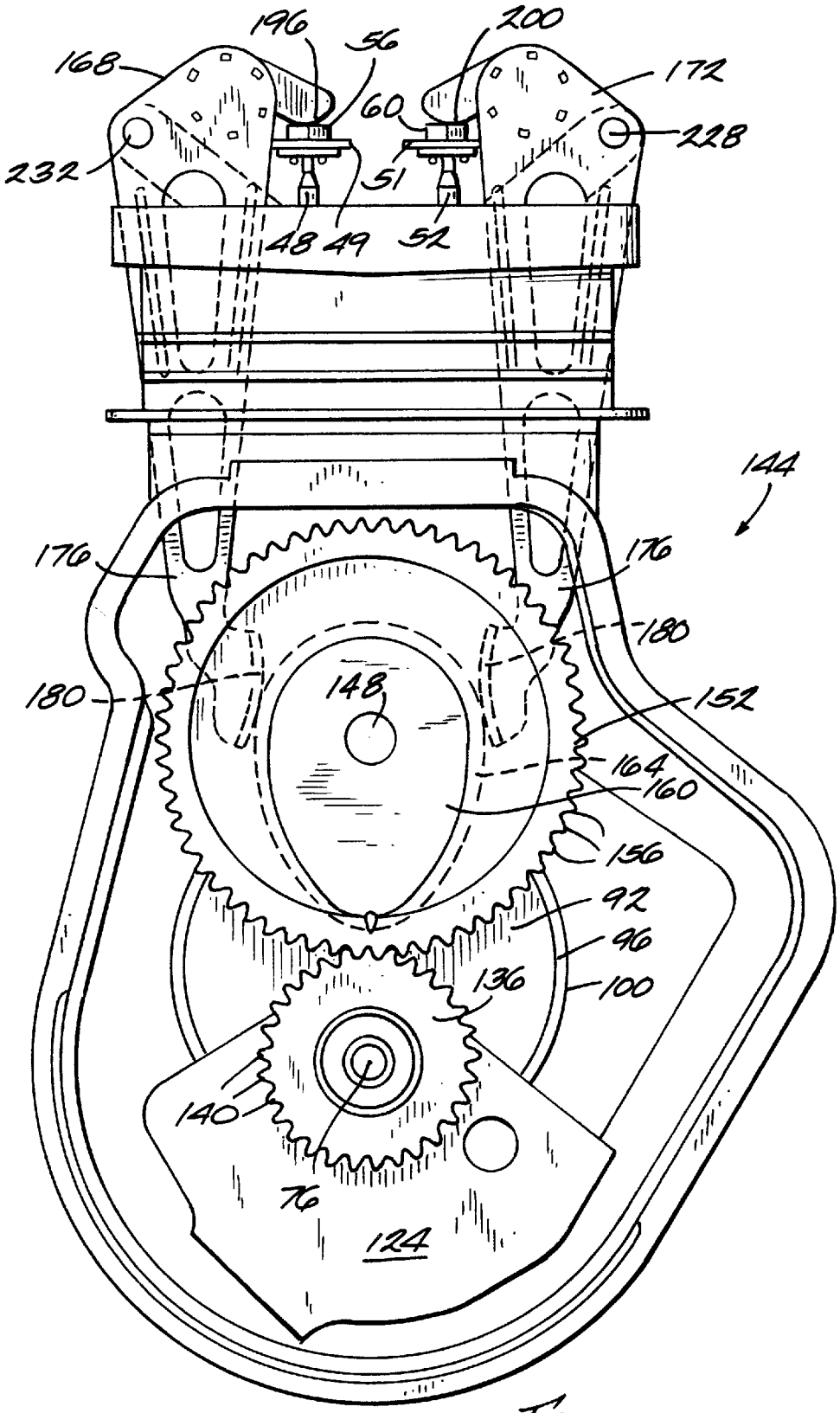
FIG. 9 is a bottom view of an alternative embodiment of the overhead valve engine of FIG. 1, with engine base removed.

In a further alternative embodiment illustrated in FIG. 9, the levers 168, 172 may be arranged such that they pivot on separate but substantially parallel pivot axes 228, 232. Performance of the levers 168, 172 would be otherwise substantially unaffected.

We claim:

1. A direct lever system for an engine, the system comprising:

a cylinder bore, the cylinder bore having an outer end;

a cam assembly having at least one cam surface and an axis inward of the outer end of the cylinder bore;

two valves having opened and closed positions;

two valve stem assemblies, each including a valve stem that is attached to a valve;

a cylinder head substantially enclosing the outer end, the valves being seated in the cylinder head; and two pivotably mounted valve operating levers, each lever including a first lever arm having a cam follower in contact with the at least one cam surface, a pivot axis about which the lever pivots, and a valve arm, where movement of the lever caused by the at least one cam surface causes the lever to pivot and the valve arm to depress the valve stem and thus open the valve.

2. The system of claim 1, further including a valve stem assembly biasing means.

3. The system of claim 2, further including a lever biasing means separate from the valve stem biasing means.

4. The system of claim 1, the pivot axis of each lever being coincidental.

5. The system of claim 1, the pivot axis of each lever being substantially parallel.

6. The system of claim 1, each lever being formed from a single piece.

7. The system of claim 1, each lever being formed from two stampings and a tube.

8. The system of claim 7, each lever being formed by resistance welding.

9. The system of claim 1, further comprising two cam lobes mounted on the cam shaft, each cam lobe having a cam surface, and each first lever arm being in contact with a separate cam surface.

10. The system of claim 1, each lever being generally L-shaped.

11. The system of claim 1, further comprising an engine housing and a pin mounted in the housing, the cam assembly being rotatably mounted on the pin.

12. The system of claim 1, each valve stem having a longitudinal axis, the valve stem axes being substantially parallel to each other.

13. The system of claim 1, each valve stem having a longitudinal axis, the valve stem axes intersecting.

14. The system of claim 1, each valve stem having a longitudinal axis, the valve stem axes being skew lines.

15. The system of claim 1, the pivot axis being located between the first lever arm and the valve arm.

16. The system of claim 1, further including a lash adjustment means.

17. The system of claim 16, the lash adjustment means being valve stem caps.

18. An engine comprising:

a cylinder bore, the cylinder bore having an outer end;

a crankshaft assembly including a substantially straight crankshaft, a substantially cylindrical journal eccentrically mounted on the crankshaft, a connecting rod rotatably mounted on the journal, a counterweight mounted on the crankshaft, and a timing gear mounted on the crankshaft;

a cam shaft having at least one cam surface and an axis inward of the outer end of the cylinder bore;

two valves having opened and closed positions;

two valve stems, each valve stem being attached to a valve;

a cylinder head substantially enclosing the outer end, the valves being seated in the cylinder head; and two pivotably mounted valve operating levers, each lever including a first lever arm having a cam follower in contact with the at least one cam surface, a pivot axis about which the lever pivots, and a valve arm in contact with a valve stem, where movement of the lever caused by the at least one cam surface causes the lever to pivot and the valve arm to depress the valve stem and thus open the valve.

19. The engine of claim 18, further including a valve stem biasing means.

20. The engine of claim 19, further including a lever biasing means separate from the valve stem biasing means.

21. The engine of claim 18, the pivot axis of each lever being coincidental.

22. The engine of claim 18, the pivot axis of each lever being substantially parallel.

23. The engine of claim 18, each lever being formed from a single piece.

24. The engine of claim 18, each lever being formed from two stampings and a tube.

25. The engine of claim 24, each lever being formed by resistance welding.

26. The engine of claim 18, the connecting rod being a single piece.

27. The engine of claim 18, further comprising two cam lobes mounted on the cam shaft, each cam lobe having a cam surface, and each first lever arm being in contact with a separate cam surface.

28. The engine of claim 18, each lever being generally L-shaped.

29. The engine of claim 18, the pivot axis being located between the first lever arm and the valve arm.

30. The engine of claim 18, further including a lash adjustment means.

31. The engine of claim 30, the lash adjustment means being valve stem caps.

* * * * *

UNITED STATES PATENT AND TRADEMARK OFFICE

CERTIFICATE OF CORRECTION

PATENT NO. : 6,349,688
DATED : February 26, 2002
INVENTOR(S) : Gary J. Gracyalny, David Procknow, Art Poehlman and Scott A. Funke It is certified that error appears in the above-identified patent and that said Letters Patent is hereby corrected as shown below:

Title page,
Item [75], should read:
Gary J. Gracyalny
David Procknow
Art Poehlman
Scott A. Funke

Signed and Sealed this

Twenty-first Day of May, 2002

*Attest:*

*Attesting Officer*

JAMES E. ROGAN
*Director of the United States Patent and Trademark Office*